US005415831A

United States Patent [19]

Baumann et al.

[11] Patent Number: 5,415,831

[45] Date of Patent: May 16, 1995

[54] METHOD OF PRODUCING A MATERIAL BASED ON A DOPED INTERMETALLIC COMPOUND

[75] Inventors: Robert Baumann, Klingnau; Joachim Rösler, Unterehrendingen; Christoph Tönnes, Birmenstorf, all of Switzerland

[73] Assignee: ABB Research Ltd., Zurich, Switzerland

[21] Appl. No.: 165,409

[22] Filed: Dec. 13, 1993

[30] Foreign Application Priority Data

Jan. 25, 1993 [DE] Germany ..... 43 01 880.7

[51] Int. Cl.[6] ..... B22F 3/16

[52] U.S. Cl. ..... 419/38; 419/6; 419/8; 419/23; 419/29; 419/32; 419/48; 419/49; 419/54

[58] Field of Search ..... 419/6, 23, 8, 29, 32, 419/49, 53, 54, 48, 38; 148/671; 29/889.7; 75/249; 420/62, 418, 550

[56] References Cited

U.S. PATENT DOCUMENTS

| | | | |
|---|---|---|---|
| 4,842,819 | 6/1989 | Huang et al. | 420/418 |
| 4,847,044 | 7/1989 | Ghosh | 419/8 |
| 4,851,193 | 7/1989 | Mahajan et al. | 420/550 |
| 5,098,469 | 3/1992 | Rezhets | 75/249 |
| 5,098,650 | 3/1992 | Eylon et al. | 419/48 |
| 5,157,744 | 10/1992 | Nazmy | 420/62 |
| 5,207,982 | 5/1993 | Nazmy et al. | 420/418 |
| 5,226,985 | 7/1993 | Kim et al. | 148/671 |
| 5,286,443 | 2/1994 | Nazmy et al. | 420/418 |
| 5,299,353 | 4/1994 | Nazmy et al. | 29/889.7 |

*Primary Examiner*—Donald P. Walsh
*Assistant Examiner*—John N. Greaves
*Attorney, Agent, or Firm*—Burns, Doane, Swecker & Mathis

[57] ABSTRACT

The method serves to produce a material based on a doped intermetallic compound. In carrying out the method, at least two differently doped powders each based on the intermetallic compound are selected. One of the two powders predominantly has coarse-grained particles. On the other hand, another powder is formed from comparatively fine-grained particles composed of a material having a lower creep strength but a higher ductility than the material of the coarse-grained powder. The at least two powders are mixed with one another in a ratio serving to establish a desired mixed microstructure and then hot-compacted and heat-treated to form the material.

Material produced by this method is suitable for components which are exposed to high mechanical loads at high temperatures, such as, in particular, gas-turbine blades or turbine wheels of turbo chargers.

20 Claims, 1 Drawing Sheet

METHOD OF PRODUCING A MATERIAL BASED ON A DOPED INTERMETALLIC COMPOUND

BACKGROUND OF THE INVENTION

1. Field of the Invention

Alloys based on doped intermetallic compounds are acquiring increasing importance in materials technology. This is primarily due to the fact that numerous alloys based on a doped intermetallic compound, in particular an aluminide, are notable for high strength despite a low density. A difficulty in the case of such alloys is, however, a ductility which is inadequate for numerous applications.

2. Discussion of Background

In this connection, the invention proceeds from a prior art such as that which emerges, for instance, from the paper by Young-Won Kim entitled High-Temperature Ordered Intermetallic Alloys IV, "Recent Advances in Gamma Titanium Aluminide Alloys", Symposium Nov. 27–30, 1990, Boston, Mass. USA (MRS Proc. Vol. 213, pages 777–794).

From the prior art, it is known that those properties of an intermetallic compound which are critical for the application as a material for thermally stressed components are decisively determined by the microstructure and the grain size. In the case of an intermetallic compound based on doped gamma-titanium aluminide, the material structure determined by the microstructure and by grain size very substantially influences, in particular, the room-temperature elongation at break and the creep strength at the high temperatures to which components, such as, in particular, gas-turbine blades or turbine wheels of turbo chargers, made of such materials are exposed. Fine-grained duplex microstructures having mean grain sizes of approximately 20 μm yield room-temperature elongations at break of typically up to 2%. Materials having such duplex microstructures have, however, a comparatively low creep behavior and are accordingly not particularly suitable as blade material for gas turbines. On the other hand, coarse-grained microstructures composed of lamellae having mean sizes of typically approximately 500 μm have only a very low elongation at break of typically approximately 0.4% at room temperature, the creep behavior of a material having such a microstructure is nevertheless very good.

Hitherto, however, it has not yet been possible to produce materials which are based on doped intermetallic compounds having optimum microstructure and which have adequate ductility and also strength for use as gas-turbine blades.

In the production of a material based on, for example, gamma-titanium aluminide as intermetallic compound, a material having coarse-grained microstructure and a lamellar structure is formed if a casting method is applied. Although such a material is very creep-resistant at high temperatures, it has a very low ductility at room temperature.

Forging and shaping the cast material yields a dynamically recrystallized, fine-grained duplex microstructure having substantially improved ductility but also having substantially reduced creep properties. Such a duplex microstructure often has, in addition, inhomogeneities which take the form of bands.

The production of a material based on gamma-titanium aluminide by powder-metallurgy methods yields, after hot isostatic compacting and heat treatment, a material having either a fine-grained or a coarse-grained microstructure. Depending on the type of microstructure, such a material has either an unduly low creep strength or an unduly low ductility.

SUMMARY OF THE INVENTION

Accordingly, one object of the invention is to provide a novel method of producing a material based on a doped intermetallic compound, with which method the properties of the material can readily be matched to predetermined boundary conditions.

The method according to the invention is remarkable, in particular, for the fact that a material having virtually any desired microstructure and therefore having systematically determined properties can be produced in an extremely simple manner. The method can be carried out by technologically simple method steps, such as powder mixing, hot compacting and heat treatment, and is therefore particularly economical.

To carry out the method, only two differently doped starting powders based on an intermetallic compound and having different particle sizes, such as, in particular, those made, for instance, of gamma-titanium aluminide, are needed. Depending on particle size and the nature of the two powders, materials having virtually any desired mixed microstructures exhibiting a coarse- and a fine-grained component and therefore having desired properties can then be produced. In producing the starting powder, it is only necessary to ensure that coarse-grained material is provided for the coarse-grained microstructure component and fine-grained material correspondingly for the fine-grained microstructure component. The fine-grained material has a greater ductility than the coarse-grained material. Therefore, if the coarse-grained material has high strength and creep resistance accompanied at the same time by high brittleness, a material having high strength and good creep behavior accompanied at the same time by good ductility can be obtained if the fine-grained powder forms the matrix of the microstructure and serves to receive the coarse-grained, strength-increasing material. The microstructure of the material and consequently its properties can additionally be influenced by adding further doped powders based on the intermetallic compound and differently doped in each case.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1:
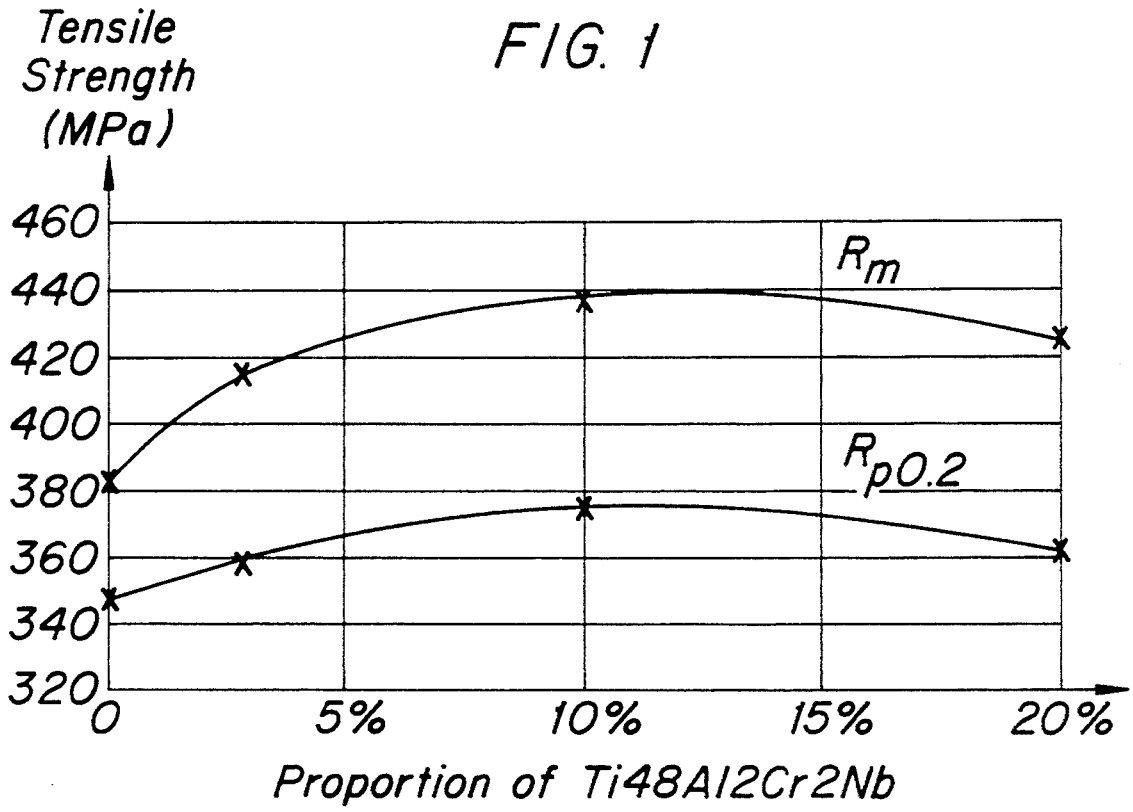
FIG. 1 shows a diagram in which the tensile strength $R_m$ and the 0.2 proof stress $R_{p0.2}$ of material produced from powders of Ti48Al3Cr and Ti48Al2Cr2Nb by the process according to the invention, as a function of the proportion of Ti48Al2Cr2Nb powder.

Two alloys having the compositions specified below were melted in a vacuum furnace:

Alloy Ti48Al3Cr:48% by weight aluminum, 3% by weight chromium, the remainder being unavoidable impurities and titanium, Alloy Ti48Al2Cr2Nb: 48 % by weight aluminum, 2% by weight chromium, 2% by weight niobium, the remainder being unavoidable impurities and titanium.

The alloy Ti48Al3Cr, which was crystallized with a coarse-grained, laminated structure and had a good strength and a good creep behavior at high temperatures, for example 800° C., was atomized to form a powder having a mean particle size of approximately 500 μm. Depending on the requirements imposed on the material to be produced, the mean particle size may be between 100 and 1000 μm but a particle size lying between 200 and 500 μm is generally to be preferred.

The alloy Ti48Al2Cr2Nb, which was crystallized with a fine-grained duplex structure and has a comparatively good ductility compared with the alloy Ti48Al3Cr, was atomized to form a powder having a mean particle size of approximately 100 μm. Depending on the requirements imposed on the material to be produced, the mean particle size may be between approximately 20 and 250 μm, but a particle size of less than 150 μm is generally to be preferred.

The two powders were intensively mixed together for approximately 30 min. In this process, the following mixing ratios in % by weight were maintained:

| | | | |
|---|---|---|---|
| Proportion of alloy Ti48Al2Cr2Nb | 3 | 10 | 20 |
| Proportion of alloy Ti48Al3Cr | remainder | remainder | remainder |

The mixed powders and powder of the alloy Ti48Al3Cr were hot-isostatically compacted at a pressure of approximately 100 to 300 MPa, preferably 200 MPa, and at temperatures of approximately 1000° to 1150° C., preferably 1080° C. The compacted material was then subjected to a two-stage heat treatment. In a first stage of the heat treatment, the hot-compacted material was first exposed to temperatures of between 1250° to 1450° C., typically 1350° C. over a time period of $1^h$ to $5^h$, typically $2^h$, and, in a second stage, it was then exposed to temperatures of between 900° and 1100° C., typically 1000° C. over a time period of 2 to $10^h$, typically $6^h$.

Metallographic bodies for microstructure investigations and rod-shaped specimen bodies for mechanical material tests were then produced from the resulting material. The specimen bodies had a rod length corresponding to about 5 times their diameter.

Micrographs of the metallographic bodies revealed that, depending on the mixing ratio of the two powders, mixed microstructures containing different proportions of coarse-grained (Ti48Al3Cr) and fine-grained microstructure (Ti48Al2Cr2Nb) are established. Material produced from the alloy Ti48Al3Cr had, as expected, only a coarse-grained microstructure.

Figure 2:
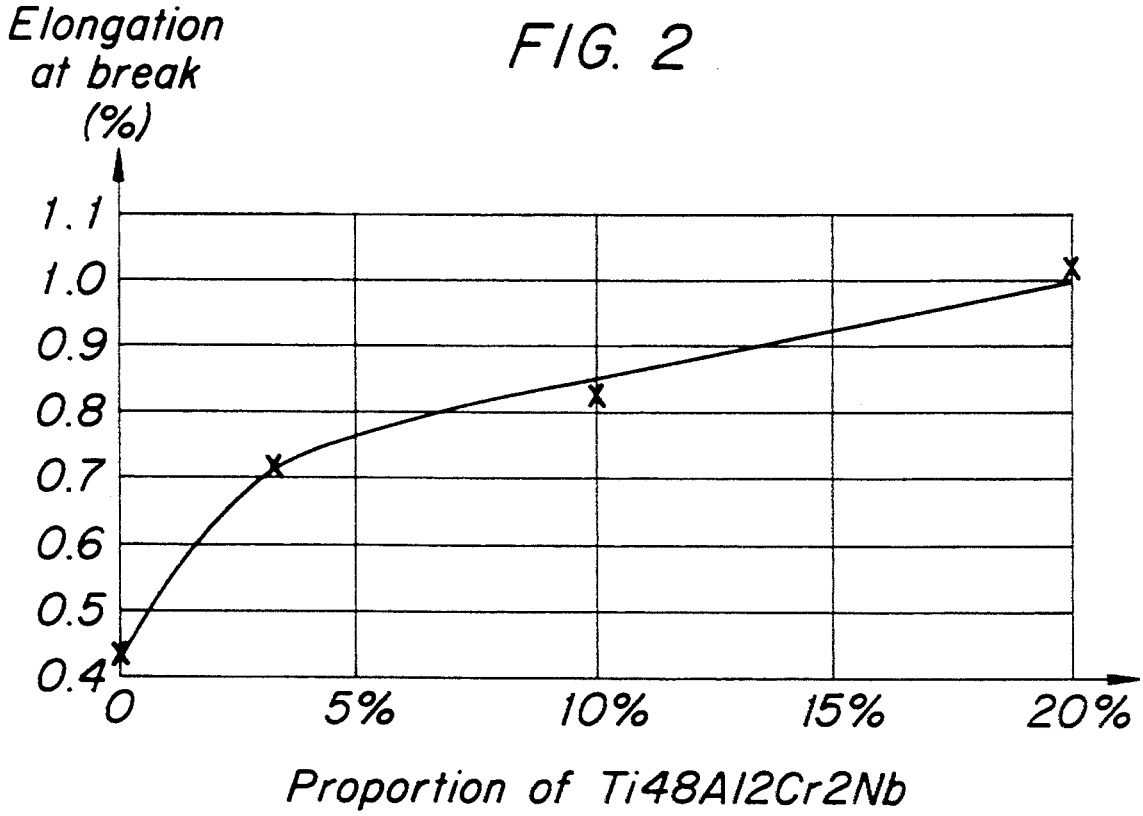
FIG. 2 shows a diagram in which the elongation at break of the material mentioned in FIG. 1 is shown as a function of the proportion of Ti48Al2Cr2Nb powder.

The test values determined from the specimen bodies are to be found in the diagrams shown in FIGS. 1 and 2.

From FIG. 1, it can be seen that the tensile strength $R_m$ and the 0.2 proof stress $R_{p0.2}$ of the material produced by the method according to the invention first increase surprisingly as the proportion of fine-grained Ti48Al2Cr2Nb increases and only fall above a proportion amounting approximately to between 10 and 15% by weight of the fine-grained material in the two starting powders or in the material. Obviously, the material produced by the process according to the invention undoubtedly has a better strength than a material based on a coarse-grained powder (alloy Ti48Al3Cr) and produced in a similar manner but without mixing with the fine-grained powder (alloy Ti48Al2Cr2Nb) if the proportion of coarse-grained powder is at least 5 times and not more than 100 times the proportion of fine-grained powder in percentage by weight. A particularly good strength is produced if the proportion of coarse-grained powder is about 7 to 20 times, preferably 10 times, the proportion of fine-grained powder in percentage by weight. Correspondingly good values were also determined for the creep behavior at temperatures around 700° to 800° C.

FIG. 2 shows that, as the proportion of fine-grained powder (Ti48Al2Cr2Nb) increases, the elongation at break and consequently also the ductility increase. If the proportion of coarse-grained powder is about 10 times the proportion of fine-grained powder, the material produced by the method according to the invention has more than twice the elongation at break as a material based on the alloy Ti48Al3Cr and produced in a similar manner but without powder mixing.

The coarse-grained powder does not necessarily have to be limited only to the alloy Ti48Al3Cr. Good results are also to be achieved with alloys of the following composition in percentage by weight:

46–54 aluminum,
1–4 chromium,
the rest being titanium and impurities.

In addition to the alloy Ti48Al2Cr2Nb, the fine-grained powder may advantageously contain alloys having the following composition in percentage by weight:

46–54 aluminum,
1–4 chromium,
1–5 niobium,
the remainder being titanium and impurities.

As dopents for the gamma-titanium aluminide, it is possible to use not only Cr and Nb, but also other elements, such as, for instance, B, C, Co, Ge, Hf, Mn, Pt, Si, Ta, V or W. Instead of doped gamma-titanium aluminide, the intermetallic compound may also be, for instance, a nickel aluminide or an iron aluminide.

Obviously, numerous modifications and variations of the present invention are possible in light of the above teachings. It is therefore to be understood that within the scope of the appended claims, the invention may be practiced otherwise than as specifically described herein.

What is claimed and desired to be secured by Letters Patent of the United States is:

1. A method of producing a material based on a doped intermetallic compound by hot compacting powder and heat treatment of the hot-compacted powder, which comprises selecting at least two differently doped powders of an aluminide intermetallic compound, of which one contains predominantly coarse-grained particles and another contains comparatively fine-grained particles and is formed from a material having a lower creep strength but a higher ductility than the material of the coarse-grained powder, and which comprises mixing the at least two powders together prior to the hot compacting in a ratio which serves to establish a desired mixed microstructure.

2. The method as claimed in claim 1, wherein the proportion of coarse-grained powder is at least 5 times the proportion of fine-grained powder in percentage by weight.

3. The method as claimed in claim 2 wherein the proportion of coarse-grained powder is at most 100 times the proportion of fine-grained powder in percentage by weight.

4. The method as claimed in claim 1, wherein the mean particle size of the coarse-grained powder is greater than 100 and less than 1000 μm and wherein the mean particle size of the fine-grained powder is less than 250 μm.

5. The method as claimed in claim 1, wherein gamma-titanium aluminide is used as intermetallic compound.

6. The method as claimed in claim 5, wherein the coarse-grained powder has the following composition in percentage by weight:

46–54 aluminum,

1–4 chromium, the remainder being titanium and impurities.

7. The method as claimed in claim 5, wherein the fine-grained powder has the following composition in percentage by weight:

46–54 aluminum,

1–4 chromium,

1–5 niobium, the remainder being titanium and impurities.

8. The method as claimed in claim 5, wherein the hot compacting is carried out isostatically at a pressure of approximately 100 to 300 MPa at temperatures of between approximately 1000° and 1150° C.

9. The method as claimed in claim 5, wherein the heat treatment is carried out in two stages, the hot-compacted material first being exposed, in a first stage, to temperatures of between 1250° and 1450° C. over a period of time of $1^h$ to $5^h$ and then being exposed, in a second stage, to temperatures of between 900° and 1100° C. over a period of time of 2 to $10^h$.

10. A method as claimed in claim 1, wherein nickel aluminide or iron aluminide is selected as intermetallic compound.

11. A method as claimed in claim 3, wherein the proportion of coarse-grained powder is about 10 times the proportion of fine-grained powder in percentage by weight.

12. A method as claimed in claim 4, wherein the mean particle size of the coarse-grained powder is between 200 and 500 μm and the mean particle size of the fine-grained powder is less than 150 μm.

13. A method of producing a material based on a doped intermetallic compound by hot compacting powder and heat treatment of the hot-compacted powder, which comprises selecting at least two differently doped powders based on the intermetallic compound, of which one contains predominantly coarse-grained particles and another contains comparatively fine-grained particles and is formed from a material having a lower creep strength but a higher ductility than the material of the coarse-grained powder, and which comprises mixing the at least two powders together prior to the hot compacting in a ratio which serves to establish a desired mixed microstructure, the proportion of coarse-grained powder being at least 5 times the proportion of fine-grained powder in percentage by weight and gamma-titanium aluminide being used as the intermetallic compound.

14. A method as claimed in claim 13, wherein the proportion of coarse-grained powder is about 10 times the proportion of fine-grained powder in percentage by weight.

15. A method as claimed in claim 13, wherein the mean particle size of the coarse-grained powder is between 200 and 500 μm and the mean particle size of the fine-grained powder is less than 150 μm.

16. The method as claimed in claim 13, wherein the coarse-grained powder has the following composition in percentage by weight:

46–54 aluminum,

1–4 chromium, the remainder being titanium and impurities.

17. The method as claimed in claim 13, wherein the fine-grained powder has the following composition in percentage by weight:

46–54 aluminum,

1–4 chromium,

1–5 niobium, the remainder being titanium and impurities.

18. The method as claimed in claim 13, wherein the hot compacting is carried out isostatically at a pressure of approximately 100 to 300 MPa at temperatures of between approximately 1000° to 1150° C.

19. The method as claimed in claim 13, wherein the heat treatment is carried out in two stages, the hot-compacted material first being exposed, in a first stage, to temperatures of between 1250° and 1450° C. over a period of time of 1 to 5 hours and then being exposed, in a second stage, to temperatures of between 900° and 1100° C. over a period of time of 2 to 10 hours.

20. The method as claimed in claim 13, wherein the proportion of the coarse-grained powder is at most 100 times the proportion of the fine-grained powder in percentage by weight.

* * * * *